United States Patent [19]

Gisiger

[11] 4,198,837

[45] Apr. 22, 1980

[54] PERMUTATION LOCK

[75] Inventor: Urs Gisiger, Selzach, Switzerland

[73] Assignee: Amiet AG, Oberdorf, Switzerland

[21] Appl. No.: 910,014

[22] Filed: May 26, 1978

[30] Foreign Application Priority Data

May 27, 1977 [CH] Switzerland ..... 6582/77

[51] Int. Cl.[2] ..... E05B 37/12; E05B 65/52

[52] U.S. Cl. ..... 70/71; 70/312; 70/316

[58] Field of Search ..... 70/67, 68, 69, 70, 71, 70/72, 73, 74, 75, 76, 312, 316, 317, 318

[56] References Cited

U.S. PATENT DOCUMENTS

| | | | |
|---|---|---|---|
| 1,413,525 | 4/1922 | Dorozynski | 70/70 |
| 3,045,644 | 11/1974 | Lindner | 70/74 |
| 3,482,421 | 12/1969 | Franzen | 70/74 |

FOREIGN PATENT DOCUMENTS

| | | | |
|---|---|---|---|
| 2142247 | 3/1973 | Fed. Rep. of Germany | 70/312 |
| 2209769 | 9/1973 | Fed. Rep. of Germany | 70/312 |
| 1045643 | 7/1953 | France | 70/74 |

*Primary Examiner*—Robert L. Wolfe
*Attorney, Agent, or Firm*—Michael J. Striker

[57] ABSTRACT

The permutation block comprises a locking slider normally biased for movement in a locking position, a control slider normally biased for movement in the locking direction and being manually controllable for movement in an opposite direction toward holding discs of a plurality of interlocking devices determining the unlocking code for the lock, a coupling member arranged between the locking slider and the control slider, the coupling member being shiftable transversely to the direction of movement of the sliders from a normal coupling position in which it transfers the movement of the control slider to the locking slider, to a holding position in which it decouples the control slider from the locking slider to allow the control slider to enter notches provided in the holding discs when the latter are aligned in a code setting position.

9 Claims, 9 Drawing Figures

PERMUTATION LOCK

BACKGROUND OF THE INVENTION

This invention relates generally to a permutation lock and more specifically, it relates to a permutation lock that includes at least two interlocking devices each having a setting disc and a holding disc the mutual position of which determines the unlocking code, the holding discs being provided respectively with intake notches defining a starting or setting position of the internlocking devices and also an arresting mechanism adapted for disconnectably coupling the setting disc to the holding disc.

Permutation locks of this type are known from prior art, for example from the German publication DT-OS No. 2,142,065. In this known permutation lock the bolt can be opened by means of a manually controlled actuation member only so that the arresting of a closing member is possible only then when interlocking devices have been set in a perfect combination that makes the opening possible. This construction however influences the user to leave the interlocking devices in the opening combination when the lock is open so that the device could be locked with minimum effort. The setting discs of the interlocking devices are provided with signs such as numerals, for example that indicate the actual setting of the interlocking devices. This digital designation has of course the disadvantage that during the open condition of the lock any one could recognize and mark this combination so that the safeguard permutation lock is aiming for is lost. To prevent this shortcoming, the user has either to displace the setting of the interlocking devices immediately after the opening of the lock and reset it again when the locking is to be closed or he has to change the opening combination of the interlocking devices.

SUMMARY OF THE INVENTION

It is therefore a general object of the present invention to overcome the aforementioned disadvantages.

More particularly, it is an object of the invention to provide an improved permutation lock which makes it possible to keep in a simple manner the set combination in secrecy.

Another object of this invention is to provide an improved permutation lock that enables to select another combination for unlocking whenever desired.

In keeping with these objects, and others which will become apparent hereafter, one feature of the invention resides, in a permutation lock having at least two interlocking devices with holding discs having intake notches defining when aligned a setting position of the interlocking devices in a combination which comprises a locking slider normally biased for movement in a locking direction, a control slider normally biased for movement in the locking direction and being manually controllable for movement in an opposite direction toward the holding discs of the interlocking devices, a coupling member arranged between the locking slider and the control slider, the coupling member being shirtable transversely to the direction of movement of the sliders from a normal coupling position in which it transfers the movement of the control slider to the locking slider, to a holding position in which decouples the control slider from the locking slider to allow the control slider to engage the notches in the holding discs when the latter are aligned in the code setting position.

The setting discs of the interlocking devices cooperate with a stop member on the housing of the lock to limit the rotary movement of the interlocking devices in the code setting position.

The invention makes it possible to lock the closing part of the locking device also in the case of displaced code position of interlocking devices because of the fact that the bolts of the locking part connected with the locking slider can be opened against the force of the biasing spring independently from the position of the control slider so that the arresting of notches of a closing part by the bolts is possible. From the outside the permutation lock according to this invention can be opened only by means of a manually controlled actuating member when the interlocking devices are set in a proper opening combination. The user of the lock according to this invention may now immediately upon opening of the closing part of the lock shift the interlocking devices so that a third person can no longer recognize the opening combination. To close the lock of this invention it is not necessary to reset the opening combination on the interlocking devices.

The stop member cooperating with setting discs of the interlocking devices determines the zero or setting position of the latter from which by counting successive positions of the interlocking devices it is possible to determine the set opening position. Accordingly, in this arrangement, the optically visible marks for indicating the respective positions of the interlocking devices can be dispensed with. By this means the safeguard against unauthorized identification of the opening combination by a third person is considerably improved.

In order to prevent unintentional displacement of the opening combination that means an unintentional angular displacement of setting discs with respect to holding discs of respective interlocking devices, the locking part is provided with safety mechanism preventing such displacement. In a preferred embodiment, this safety mechanism includes a plurality of notches distributed on respective setting discs of the interlocking devices and cooperating with locking tongues provided on the locking slider in such a manner that the locking tongues engage the notches when the locking slider is in its open position against the force of the biasing spring. To disconnect the safety mechanism even when the manually operated actuation member is in opening position, a disconnectable coupling member is arranged between the locking slider and the control slider, this coupling member is controllable manually from the inside of the space to be locked. The coupling member is spring biased into its first position in which it couples the two sliders for movement in the opening direction. The locking slider is provided with an oblong aperture accommodating the top portion of the coupling member so that when tapered locking catches of a closing part of the lock are inserted into lock openings, the lock slider can be displaced in opening direction without affecting the movement of the control slider. On the other hand the coupling member is provided with a recess immediately below the part of the locking slider where the latter is in contact with the coupling member so that when the coupling member is brought to its raised or decoupling position and the control slider is moved in opening direction, the locking slider enters the notch in the coupling member so that the control slider can enter aligned notches in holding discs of interlocking devices without affecting the movement of the locking slider.

The permutation lock according to this invention is used for a variety of applications especially it is suitable for briefcases and suitcases, bags, casings, and so on.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 3:
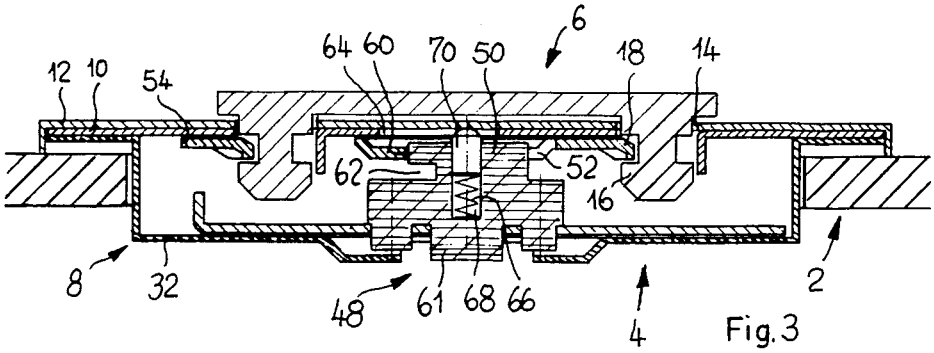
FIG. 3 is a sectional side view of the locking part of FIG. 1 taken along line III—III and shown in connection with a closing part of the lock.

FIGS. 1–7 show an object 2 such as for example a case, in which the permutation lock is secured. The permutation lock includes a locking part 4 and a closing part 6. The locking part comprises a lock housing 8 defining a bottom plane and covered with a cover plate 10. A front plate 12 is attached above the cover plate 10. Two openings 14 are provided in the front plate and in the cover plate to receive projecting catches 16 cooperating with bolts 18 of the locking part.

Figure 2:
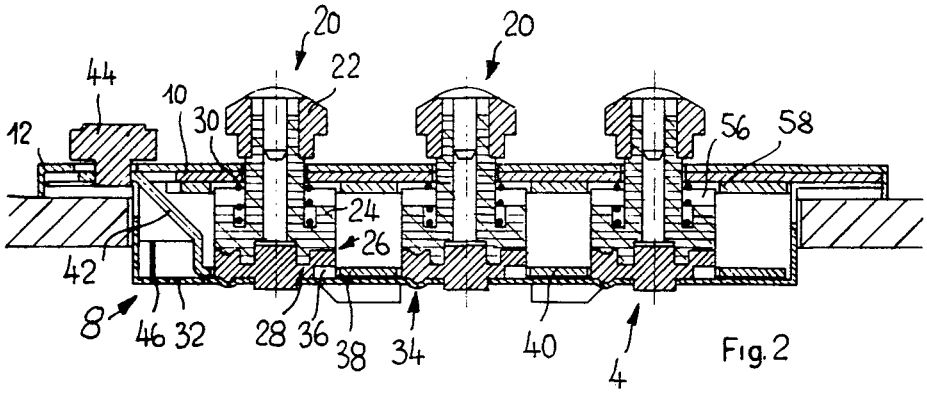
FIG. 2 is a sectional side view of the lock of FIG. 1 taken along line II—II.
Figure 1:
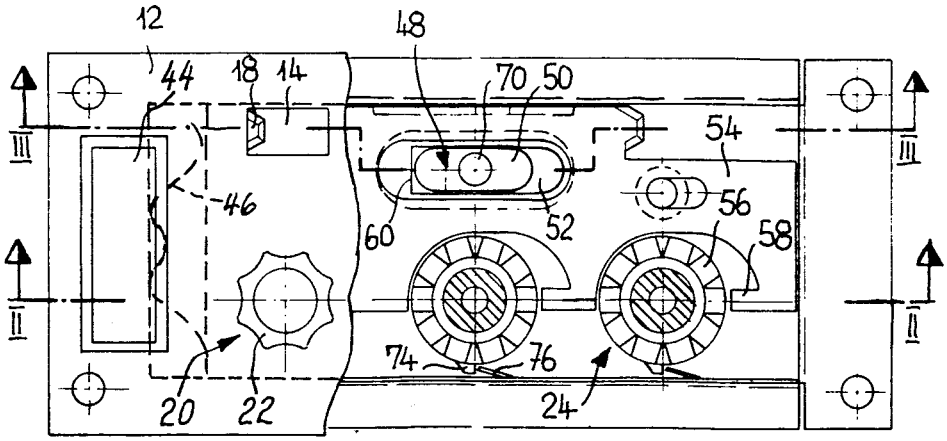
FIG. 1 is a partly cut-away top view of the locking part of the permutation lock according to this invention.

The permutation lock according to this embodiment contains three interlocking devices 20 each having a setting disc 24 adjustable in position by a manually operable control knob 22. The setting disc 24 is coupled via an arresting mechanism 26 with a holding disc 28. The setting disc 24 as well as the holding disc 28 are rotatably supported in the housing 8 and are urged against the bottom plate 32 of the housing by means of a spiral spring 30. Another arresting mechanism 34 is provided between the holding disc 28 and the bottom plate 32 and its arresting notches correspond to those in the first-mentioned arresting mechanism 26. The arresting force of the arresting mechanism 26 however is smaller than that of the arresting mechanism 34. Each holding disc 28 is provided with an intake notch 36 the angular position of which can be adjusted by turning the control knob 22. If all intake notches 36 are adjusted to be in alignment with each other they form an opening position for the lock as indicated in FIG. 2. In this opening position the holding tongues 38 of the holding slider 40 can enter the intake notches 36. This position of holding notches 36 corresponds therefore to the opening combination of the interlocking devices 20.

The holding slider 40 is slidably supported on the bottom plate 32 of the lock housing 8 and via a projection 42 is connected to a press key 44 projecting above the front plate 12. The holding slider 40 is biased by means of a spring 46 in a locking direction away from the notches 36 in the interlocking devices. The holding slider 40 supports a coupling member 48 that is displaceable perpendicularly relative to the bottom plate 32; the upper part of the coupling member is reduced in size to form an oblong plug 50 that projects into an oblong aperture 52 in a lock slider 54. The slider 54 is supported for sliding movement along the cover plate 10 and supports two bolts 18 engageable with corresponding recesses in catches 16 of closing part 6. The locking slider 54 is also biased by means of spring 46 into its closing position. The arrangement of the plug 50 of the coupling member 48 in the oblong aperture 52 is such that it permits free movement of the locking slider 54 from its locking or closing position in opening direction against the force of spring 46 when catches 16 of the closing part 6 are inserted into openings 14 in the locking part. As soon as the catches of the closing part 6 are in engagement with bolts 18 of the locking part, the only possibility how to move the locking slider 54 in opening direction is by means of the coupling member 48, the control slider 40 and the manually operated press key 44 provided that the interlocking devices have been set into their opening combination.

The permutation lock according to this invention is further provided with a disconnectable safety mechanism to prevent an accidental change of the opening combination on the interlocking devices. For this purpose the setting discs have on their periphery regularly distributed notches 56 the number and arrangement of which corresponds to the number and arrangement of snap-in or arresting notches in the arresting device 26. The locking slider 54 has an arresting tongue 58 for each interlocking device 20 that engages in a notch 56 of the safety mechanism when the locking sliders 54 is shifted into its opening position. In this manner during each opening process when the locking slider is in its opening position it blocks the rotation of the interlocking devices irrespective whether the latter are set to their opening combination or not.

Figure 4:
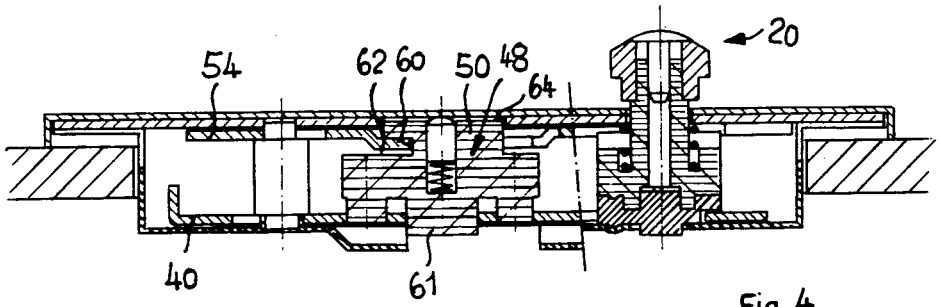
FIG. 4 is a sectional side view of the locking part of the lock of this invention taken along line IV—IV of FIG. 6.
Figure 5:
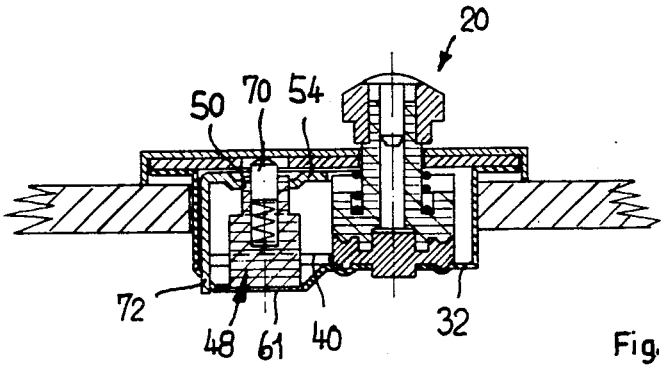
FIG. 5 is another sectional side view of the lock of FIG. 6 taken along line V—V and shown in position of FIG. 4.
Figure 6:
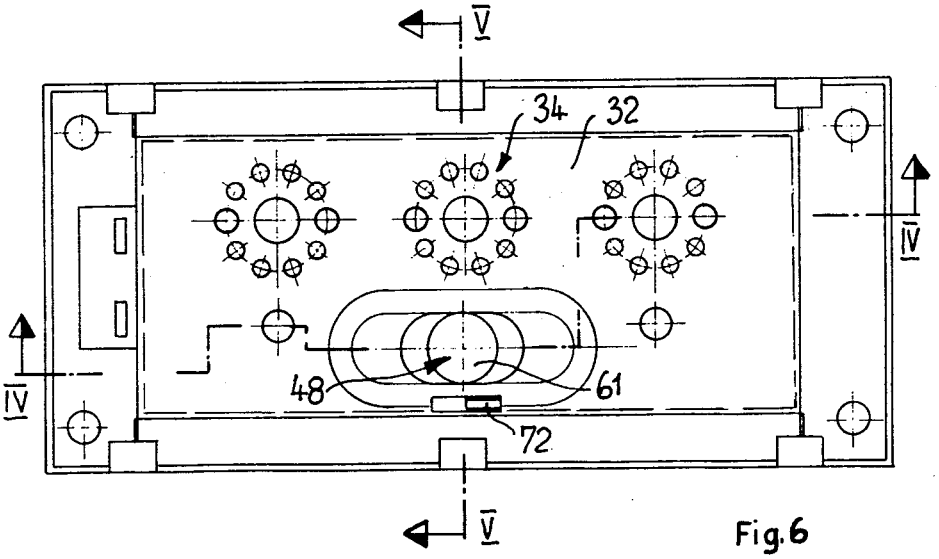
FIG. 6 is a bottom view of the lock of FIG. 1.

In order to change the opening combination of the interlocking devices, that means to change the mutual relative position of the setting disc 24 with respect to the holding disc 28, it is necessary to disconnect the safety mechanism. For this purpose the coupling member 48 is moved from its normal coupling position as shown in FIG. 3 into its raised or decoupling position as shown in FIG. 4. The coupling member is arranged so that in its normal or coupling position the edge of its plug 50 abuts against the edge 60 in the hole 52 of the locking slider 54. A bottom projection 61 of the coupling member 48 is depressed through an opening in the bottom plate 32 of the housing 8 against the force of biasing spring 68 so that the coupling member 48 takes its decoupling position as illustrated in FIG. 4. In the decoupling position the edge 60 of the oblong aperture 52 is shifted into a matching recess or notch 62 in the plug 50 so that the control slider 40 can be moved in the direction of the opening position without displacing the locking slider 54 with its bolts 58 from the locking or closing position. As mentioned above, the movement of the controlling slider 40 in the opening direction is possible only then when the interlocking devices 20 are set in a position corresponding to the opening combination in which the locking tongues 58 can engage the aligned intake notches 36 in holding discs 28. In the elevated or decoupling position of the coupling member 48, and after a displacement by the control slider 40 in the opening direction, the top portion of the plug 50 enters a matching recess in the cover plate 10 of the housing 8 and prevents thus the holding slider 40 to return into its closing position and arrests the slider 40 in the opening position. In this condition the setting discs 24 can be adjusted by means of control knobs 22 into another angular position relative to the holding discs 28 by which action the new opening combination of the interlocking devices 20 is set. Central part of the top of the coupling member 48 has a blind bore hole 68 for accommodating a biasing spring 66 that by means of a pin 70 biases the coupling member 48 against the cover plate 10 so that the coupling member is normally biased into its coupling position. To relieve the blocking of the holding slider 40 the locking slider 54 is equipped with release lug 72 that projects inwardly through the bottom plate 32 of a housing 8 and by means of which the locking slider 54 can be moved into its opening position. In this opening position the edge portion 60 of the oblong aperture 52 in the locking slider 54 is disengaged from the recess 62 in the plug 50 so that the biasing spring 56 ejects the coupling member 48 from the recess 64 in the cover plate 10 and the coupling member returns to its normal coupling position. In this normal position the plug 50 faces again the edge 60 of the oblong aperture 52 and both the holding slider 40 and the locking slider 54 are returned by the spring 46 into the locking or closing position.

In this embodiment the permutation lock has no marks or index by means of which the position of the locking devices could be ascertained from the outside. To define the position of the interlocking devices, a stop member 74 is provided on the setting discs 24 and cooperates with stationary counter-stop 76 on the housing of the lock. The setting or zero position of the interlocking devices is established by rotating individual interlocking devices counterclockwise until the stop 74 abuts against the counterstop 76. From this zero or setting position, the setting of respective interlocking devices to a desired position is initiated. The angular position of control knobs 22 can be ascertained by counting successive arresting positions in the second arresting device 34 starting from the zero position. An arresting notch corresponds thereby to a number for example so that the count of five arresting notches corresponds to the number 5. In this manner it is possible for a user of the permutation lock to adjust a new opening combination without giving any possibility to a third person to recognize it.

In setting a new opening combination the interlocking devices 20 are first brought to their original opening combination, then the coupling member 48 is depressed from the inside of the case 2 by means of a ballpoint pen into its decoupling position in which the edge portion 60 of the locking slider 54 is leveled with the recess 62 of the plug 50. Thereafter by the aid of the actuating press key 44 the holding slider 40 is moved in opening direction and during this movement the edge portion 60 of the locking slider 54 engages the notch 62 in the plug 50 of the coupling member and during this movement the coupling member also reaches the range of the recess 64 and is forced by further depressing the projection 61 to enter this recess 64 in the covering plate 10. By releasing the press key 44 the holding slider 40 is thus arrested in its opening position. At the same time the locking tongues 38 of the holding slider 40 engage the intake notches 36 and arrest all holding discs 28 in their aligned setting position. By rotating setting disc 24 by means of control knobs 22 counterclockwise into the zero setting position all interlocking devices are brought into the zero position. Now the permutation lock is ready for setting an arbitrary opening combination that is adjusted so that each interlocking device 20 is rotated clockwise by means of control knobs 22 and by counting the arresting notches the setting discs 24 are adjusted to the desired position with respect to holding disc 28. The number of arresting notches has to be counted from the zero position of each interlocking device from which the new combination will result. Subsequently, the locking slider 54 is shifted into its opening position by means of the actuation projection 72. By this action, the edge portion 60 of the oblong hole 52 disengages the notch 62 in the plug 50 and by the action of biasing spring 66 the coupling member 48 is returned to its normal coupling position and also the holding slider 40 as well as the locking slider 54 are returned into their closing or locking position. At this moment the new opening combination of the permutation lock is adjusted. By rotating the interlocking devices by means of control knobs 22 in their zero positions and by repeated setting of the newly set opening combination, the correctness of the adjustment can be verified. In the course of the re-adjustment of the opening combination it is impossible for an outsider to ascertain the new combination neither during the setting process nor thereafter.

Figure 9:
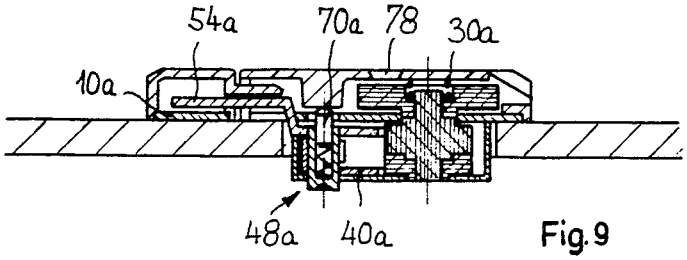
FIG. 9 is another sectional side view of the embodiment of FIG. 7 taken along line IX—IX.
Figure 8:
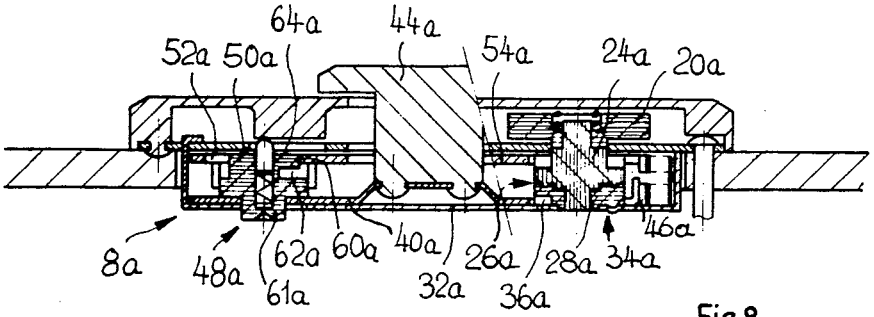
FIG. 8 is a side view of the lock of FIG. 7 taken along line VIII—VIII.
Figure 7:
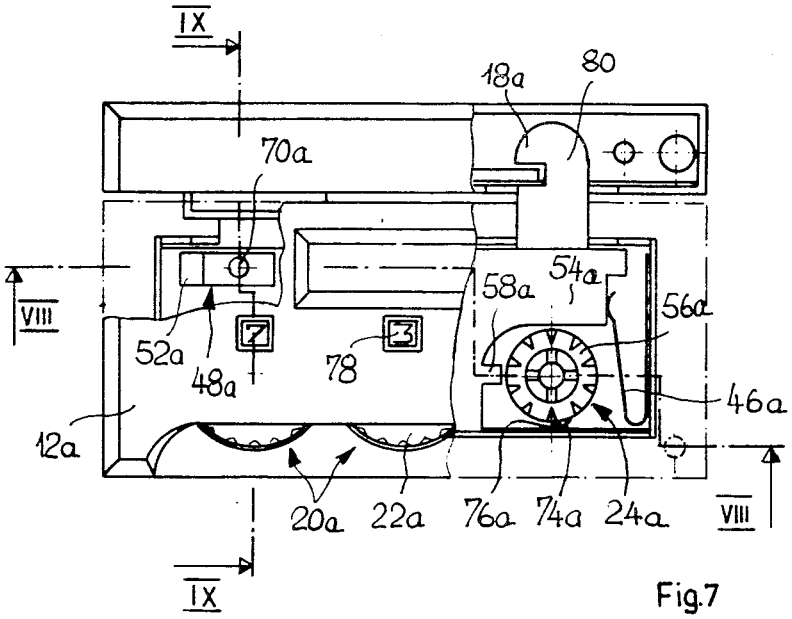
FIG. 7 is a partly cut-away top view of another embodiment of the locking part of the permutation lock according to this invention.

Referring now to FIGS. 7–9 there is shown another embodiment of the permutation lock that is constructed similarly as that shown in FIGS. 1–6 so that like parts are indicated by similar reference numerals differing only by the addition of index a.

In the permutation lock illustrated in FIGS. 7–9 the interlocking devices **20*a* are provided with marks from zero to 9, appearing in windows 78 in the front plate 12*a*. In the remaining construction the permutation lock in this embodiment has also three interlocking devices 20*a* each including a setting disc 24*a* and a holding disc 28*a* whereby the setting discs 24*a* and the holding discs 28*a* are coupled to each other by means of first arresting mechanism 26*a*. Also a second arresting mechanism 44*a* is provided between each holding disc 28*a* and the bottom plate 32*a* of the lock housing. The holding slider 40*a* is coupled to the locking slider 54*a* by means of a coupling member 48*a* in similar manner as it has been explained in connection with the first embodiment of the permutation lock shown in FIGS. 1 to 6. In the case of the permutation lock of FIGS. 7 to 9, the stops 74 and 76*a* of the modification according to FIGS. 1 and 6 can be dispensed with since the position of setting discs 24*a* is indicated by marks zero to 9. Similarly as in the preceding example, the permutation lock in this embodiment is possible to lock without setting the interlocking devices 20*a*** into their opening combination.

The permutation lock according to FIGS. 7 to 9, is further provided with a safety mechanism including locking tongues **58*a* that are engageable into notches 56*a* on the periphery of the setting disc 24*a*. To disengage the adjustment safety mechanism the coupling of the coupling member 48*a*** between the holding slider 40*a* and the locking slider 54*a* similarly as in the preceding example, is disconnectable. In order to return the coupling member 48*a* from its decoupling position in which the edge portion 60*a* of the oblong aperture 52*a* engages a recess 62*a* in the plug 50*a* of the coupling member, into its coupling position in which the plug 50*a* abuts against the edge portion 60*a* of the oblong aperture 52*a*, the locking slider 54*a* is not provided with an additional actuation lock 22 as in the preceding example, but has instead a locking tongue 80 projecting from the lock housing and supporting the locking bolt 18*a* and this locking tongue 80 serves at the same time as the actuation projection for shifting the locking slider 54*a* in the opening direction.

It will be understood that each of the elements described above, or two or more together, may also find a useful application in other types of constructions differing from the types described above.

While the invention has been illustrated and described as embodied in specific examples of the permutation lock, it is not intended to be limited to the details shown, since various modifications and structural changes may be made without departing in any way from the spirit of the present invention.

What is claimed as new and desired to be protected by Letters Patent is set forth in the appended claims.

I claim:

1. In a permutation lock including a closing part provided with catches and a separate locking part provided with at least two interlocking devices each having a setting disc, a holding disc defining an intake notch, and an arresting mechanism for disconnectably coupling the setting disc to the holding disc, a combination of said locking part comprising: a locking slider normally biased for movement in a locking direction; a control slider normally biased for movement in said locking direction and being manually controllable for movement in an opposite direction toward said holding discs; at least one locking member arranged on said locking slider to engage said catches; a coupling member arranged between said locking slider and said control slider, said coupling member being shiftable transversely to the direction of movement of said sliders from a normal coupling position in which it transfers the movement of said control slider to said locking slider, to a decoupling position in which it decouples said control slider from said locking slider to allow said control slider to engage the intake notches in said holding discs when the latter are aligned in an opening position; and a safety mechanism including a plurality of safety notches provided on the periphery of said setting discs, and holding tongues provided on said locking slider to engage said safety notches during the open position of said locking slider.

2. A combination as defined in claim 1, wherein each setting disc is provided with a stop cooperating with a stationary counter stop provided on said locking part to define the zero position of said interlocking devices.

3. A combination as defined in claim 1, wherein said locking part is enclosed in a housing having a cover plate defining a recess and a bottom plate defining an opening, said coupling member being supported on said control slider and in the closing position of said control slider said coupling member being accessible from said opening in said bottom plate, whereas in the opening position of said control slider the top part of said coupling member being insertable into said recess in said cover plate.

4. A combination as defined in claim 3, wherein each interlocking device includes an additional arresting mechanism disposed between said holding disc and said bottom plate of the housing, the number of arresting positions of said additional arresting mechanism corresponding to the first mentioned arresting mechanism and having reduced arresting force with respect to the first arresting mechanism.

5. A combination as defined in claim 1, wherein said locking slider is provided with an oblong aperture extending in the direction of movement of said locking slider, a part of said coupling member being arranged for movement in said oblong aperture and defining a recess adapted for engagement with an edge portion of said oblong aperture when said coupling member is moved in the opening direction.

6. A combination as defined in claim 5, wherein the recess in said stop portion of said coupling member in the normal coupling position of the latter is located below said edge portion of said oblong aperture so that said coupling member is in contact with said edge portion.

7. A combination as defined in claim 5, wherein said coupling member is spring biased into its normal coupling position.

8. A combination as defined in claim 7, wherein said controlling slider displaces said coupling member in opening direction opposite to said recess in said cover plate of lock housing whereby said coupling member being shiftable through said opening in said bottom plate of the housing into engagement with said recess in said cover plate, said locking slider including a projection directed through said bottom opening to move said locking slider in opening direction for releasing the coupling member from said recess in the cover plate.

9. A combination as defined in claim 8, wherein said projection is in the form of a locking tongue supporting locking bolts and projecting through the housing of said locking part.

* * * * *